United States Patent [19]

Gajjar

[11] Patent Number: 4,638,648

[45] Date of Patent: Jan. 27, 1987

[54] LAYERED WARP KNITS

[75] Inventor: Bharat J. Gajjar, Wilmington, Del.

[73] Assignee: E. I. Du Pont de Nemours and Company, Wilmington, Del.

[21] Appl. No.: 858,142

[22] Filed: May 1, 1986

[51] Int. Cl.[4] ..... D04B 23/08

[52] U.S. Cl. ..... 66/193; 66/202

[58] Field of Search ..... 66/193, 190, 192, 193, 66/202, 196

[56] References Cited

U.S. PATENT DOCUMENTS

| | | | |
|---|---|---|---|
| 2,910,853 | 11/1959 | Howard | 66/193 |
| 3,390,549 | 7/1968 | Brand | 66/192 X |
| 3,710,599 | 1/1972 | Sarmiento | 66/193 |
| 3,733,859 | 5/1973 | Wittmann | 66/193 |
| 3,910,075 | 10/1975 | Holliday | 66/190 |
| 4,003,224 | 1/1977 | Odham | 66/193 |

FOREIGN PATENT DOCUMENTS

| | | | |
|---|---|---|---|
| 688246 | 6/1964 | Canada | 66/62 |
| 60-7742 | 2/1985 | Japan | 66/192 |

*Primary Examiner*—Ronald Feldbaum

[57] ABSTRACT

Warp knit technology is applied to produce a multi-layered fabric using a four bar stitch construction with spandex yarn in the last guide bar with knit or laid in stitch.

7 Claims, 10 Drawing Figures

LAYERED WARP KNITS

BACKGROUND OF THE INVENTION

This invention relates to warp knitted fabrics, and more particularly to multi-layered warp knit fabrics having a novel four bar stitch construction utilizing spun yarn as one of the layers.

Multi-layered warp knit fabrics using spun yarn are known, but because the stitch construction of these fabrics requires that the spun yarn be knitted in to provide a stable knit structure that will not distort, the knitting speeds are below the desired commercial range of 600 to 2000 stitches per minute. One way to increase the knitting speeds is to use a laid-in rather that a knit stitch for the spun yarns so as disclosed in my Canadian Pat. No. 688,246 issued June 9, 1964. This particular construction places the back bar spun yarn in the middle of the fabric where it is not exposed to either surface whereas it would be highly desirable to have the visual and tactile asthetics of the spun yarn exposed in at least one surface of the fabric.

SUMMARY OF THE INVENTION

This invention overcomes the above problems by providing a knitted fabric that includes four (4) sets of threads knitted in a stitch pattern from first, second, third and fourth guide bars of a warp knitting machine. The first guide bar is partially threaded with a continuous filament yarn in a pattern of at least one end in and one end out. The first guide bar yarn is knit with a chain stitch. The second guide bar is partially threaded with either a spun or textured yarn having a denier at least twice that of the first guide bar yarn. The threading arrangement of the second guide bar duplicates the threading arrangement of the first guide bar. The second guide bar yarn is laid-in. The third guide bar yarn is fully threaded with a continuous filament yarn which is knitted in and the fourth guide bar is fully threaded with an elastomeric yarn which is knitted in with a float stitch or is laid-in (e.g., 0—0, 3—3).

DETAILED DESCRIPTION OF THE ILLUSTRATED EMBODIMENTS

Figure 1A:
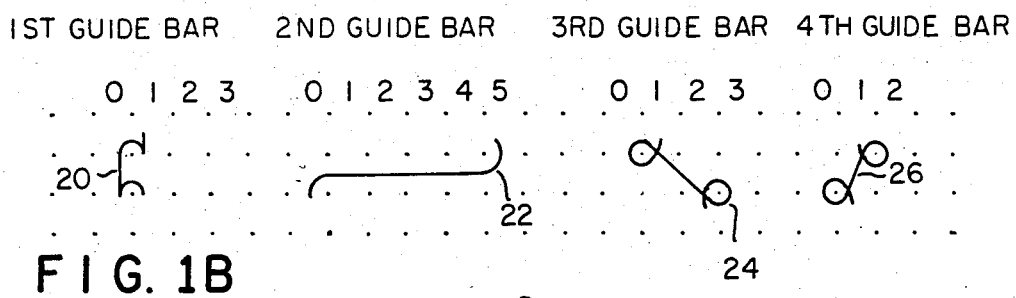
FIGS. 1A–1I are stitch pattern diagrams for the fabrics of this invention.
Figure 1B:
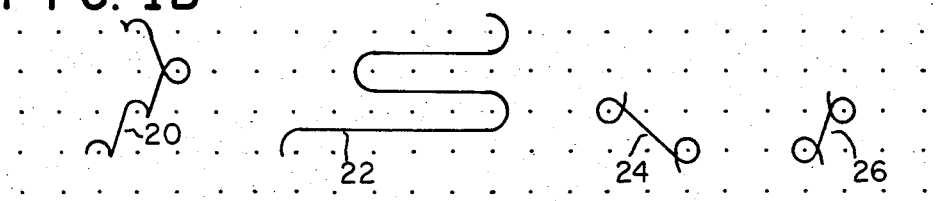
Figure 1C:
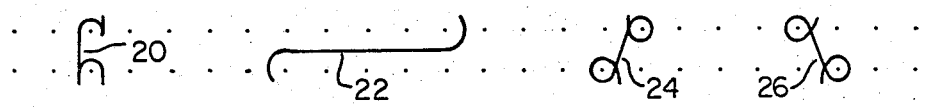
Figure 1D:
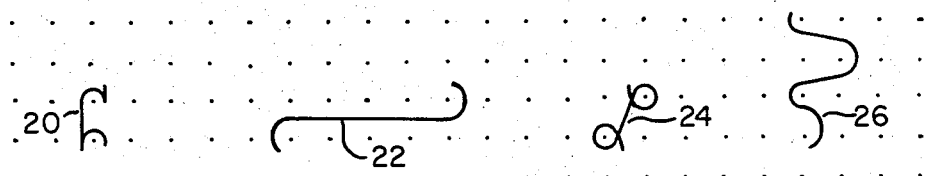
Figure 1E:
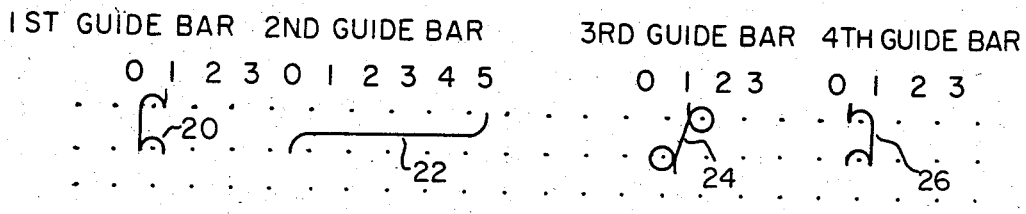
Figure 1F:
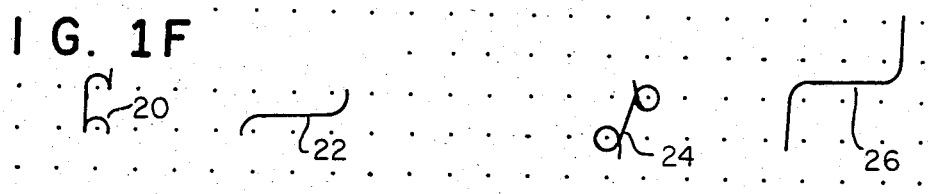
Figure 1G:
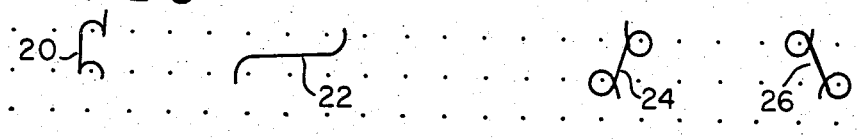
Figure 1H:
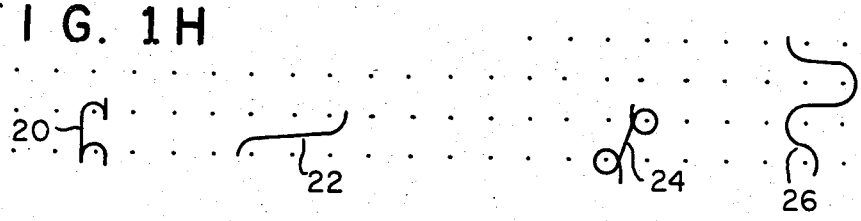
Figure 1I:
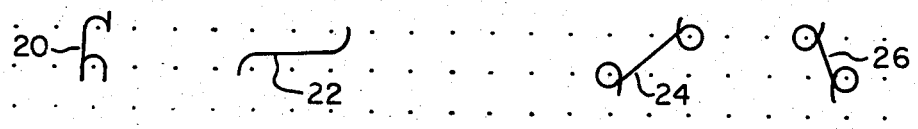

The invention is best defined in terms of stitch patterns as shown in FIGS. 1A through 1I. For aech of the Figs. a single needle bar is employed, being fed from four guide bars designated first, second third and fourth bars. This first bar feeds a continuous filament nonelastomeric yarn such as nylon yarn designated 20; the second guide bar feeds an either spun yarn blended from cotton and polyester or a textured polyester yarn 22 having a denier at least about twice that of the first bar yarn; the third guide bar feeds a continuous filament yarn 24 such as a nylon yarn; and the fourth guide bar yarn feeds an elastomeric yarn such as spandex yarn and designated 26. Knitting needle positions for each of two successive courses are represented in the diagrams by horizontal rows of dots, the top row representing the course formed immediately after the course formed by the bottom row. Referring to FIG. IA the stitch construction of the fabric is notationally set out and shows that the threads of the first guide bar one of which is designated 20 have back-and-forth movement to nonadjacent needles in successive courses as indicated by the numbers 1-0,0-1. The threads of the second, third and fourth guide bar designated 22,24 and 26 respectively have similar movements. The movements of needles to successive courses are indicated below each diagram by their numbers as set forth in Table I.

TABLE I

| FIG. No. | 1st Bar | 2nd Bar | 3rd Bar | 4th Bar |
|---|---|---|---|---|
| 1A | 1-0, 0-1 | 0-0, 5-5 | 2-3, 1-0 | 1-0, 1-2 |
| 1B | 0-1, 1-2, 2-3, 2-1 | 0-0, 6-6, 2-2, 6-6 | 2-3, 1-0 | 1-0, 1-2 |
| 1C | 1-0, 0-1 | 0-0, 5-5 | 1-0, 1-2 | 1-2, 1-0 |
| 1D | 1-0, 0-1 | 0-0, 5-5 | 1-0, 1-2 | 1-1, 0-0, 2-2, 0-0 |
| 1E | 1-0, 0-1 | 0-0, 5-5 | 1-0, 1-2 | 0-1, 1-0 |
| 1F | 1-0, 0-1 | 0-0, 3-3 | 1-0, 1-2 | 0-0, 0-0, 3-3, 3-3 |
| 1G | 1-0, 0-1 | 0-0, 3-3 | 1-0, 1-2 | 1-2, 1-0 |
| 1H | 1-0, 0-1 | 0-0, 3-3 | 1-0, 1-2 | 1-1, 0-0, 2-2, 0-0 |
| 1I | 1-0, 0-1 | 0-0, 3-3 | 1-0, 2-3 | 1-2, 1-0 |

For guide bar threading, see Table III.

Figure 2:
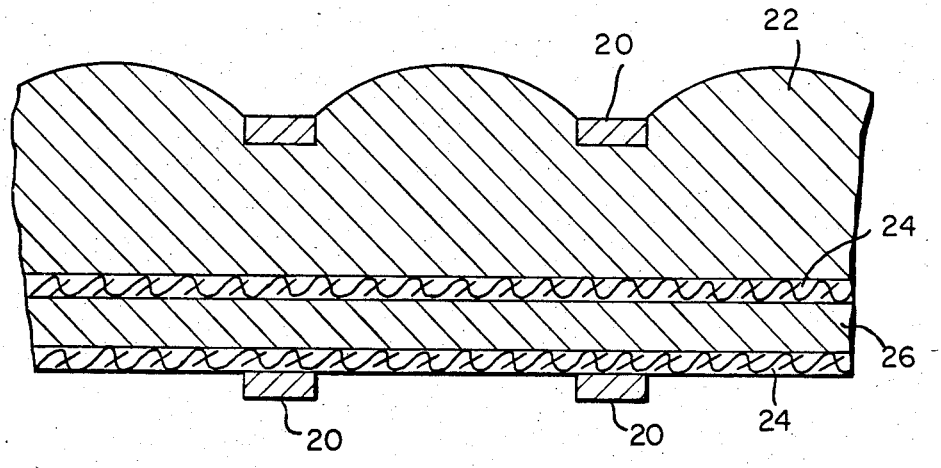
FIG. 2 is a schematic sectional view of the fabric of this invention.

To illustrate the structure and functional advantage of this invention, a schematic sectioned view is shown in FIG. 2 representative of the stitch construction of FIG. 1A. The first guide bar yarn 20 is a continuous filament nylon yarn and is hydrophobic in nature. The second guide bar yarn 22 is either a 50/50 polyester/-cotton spun yarn which is hydrophilic in nature or a textured polyester yarn but in either case the denier will be at least twice that of the yarn 20. The third guide bar yarn 24 is another nylon yarn and the fourth guide bar yarn 26 is an elastomeric yarn such as spandex. The spandex yarn stabilizes the fabric and due to its propensity to pull in, it forces more of the second guide bar yarn 22 (spun laid-in) to the fabric surface thus accentuating the durable characteristics of yarn 22 on the surface. The elastomeric yarn also stabilizes the laid-in spun yarn 22 in the knit structure. When using cotton or a cotton blend for yarn 22, nylon for yarns 20,24 and spandex for yarn 26 the fabric produced has an outer layer 22 of hydrophilic fiber (cotton) that absorbs moisture and an inner layer 20,24 of hydrophobic filament yarns that forward moisture to the outer layer. During wear, maximum comfort is achieved by placing the hydrophobic side of the fabric next to the skin. In this manner prespiration on the skin will be transported through the multilayered fabric to the outer layer of yarn 22 where it subsequently evaporates. The fabric remains dry on the inside next to the skin imparting comfort to the wearer.

While the invention has been disclosed using four guide bars and a single needle bed, it should be understood that this technology could be used on a one or two-needle bed warp knit machine with three or more guide bars.

Test Methods

Thickness is measured according to ASTM D1777-64 using apparatus commercially available from Customer Scientific Instruments, Inc., Whippany, N.J. Thickness is measured in inches.

Bulk (specific volume) is calculated according to the formula:

$$\text{Bulk (cm}^3\text{/g)} = \frac{2.54 \times 8361 \times T}{28.35\ W}$$

wherein

T = Thickness (inches)

W = Weight (g/cm$^2$)

Hand Stretch is the length of a fabric sample upon stretching by hand expressed as a percentage of original relaxed length.

EXAMPLE 28 and 32 guage tricot knitting machines were used to produce fabrics with stitch constructions as shown in FIGS. 1A–1I and Table I. The yarn layout, guide bar threading, fabric details of construction and finished fabric properties are shown in Tables II, III, IV and V.

TABLE II

| | Yarn Layout | | | |
|---|---|---|---|---|
| Item No. | 1st Bar | 2nd Bar | 3rd Bar | 4th Bar |
| 1A | 40-13 nylon | 50/1 cc 50/50 polyester/cotton | 40-12 cospun* nylon/polyester | 40 den. spandex |
| 1B | " | 50/1 cc 50/50 polyester/cotton | 40-12 cospun* nylon/polyester | 40 den. spandex |
| 1C | " | 50/1 cc 50/50 polyester/cotton | 40-12 cospun* nylon/polyester | 40 den. spandex |
| 1D | " | 50/1 cc 50/50 polyester/cotton | 40-12 cospun* nylon/polyester | 40 den. spandex |
| 1E | " | 50/1 cc 50/50 polyester/cotton | 40-12 cospun* nylon/polyester | 40 den. spandex |
| 1F | " | 50/1 cc 50/50 polyester/cotton | 40-12 cospun* nylon/polyester | 40 den. spandex |
| 1G | " | 50/1 cc 50/50 polyester/cotton | 40-12 cospun* nylon/polyester | 40 den. spandex |
| 1H | " | 50/1 cc 50/50 polyester/cotton | 40-12 cospun* nylon/polyester | 40 den. spandex |
| 1I | " | 50/1 cc 50/50 polyester/cotton | 40 den. spandex | 40-13 nylon |

*made according to U.S. Pat. No. 3,681,910

TABLE III

| | Guide Bar Threading | | | |
|---|---|---|---|---|
| Item No. | 1st Bar | 2nd Bar | 3rd Bar | 4th Bar |
| 1A | Two ends in, two ends out | Two ends in, two ends out | Full | Full |
| 1B | Two ends in, two ends out | Two ends in, two ends out | " | " |
| 1C | Two ends in, two ends out | Two ends in, two ends out | " | " |
| 1D | Two ends in, two ends out | Two ends in, two ends out | " | " |
| 1E | Two ends in, two ends out | Two ends in, two ends out | " | " |
| 1F | One end in, one end out | One end in, one end out | " | " |
| 1G | One end in, one end out | One end in, one end out | " | " |
| 1H | One end in, one end out | One end in, one end out | " | " |
| 1I | One end in, one end out | One end in, one end out | " | One end out, One end in |

TABLE IV

| | Fabric Details of Construction | | | | | | |
|---|---|---|---|---|---|---|---|
| | | | | Runner Length - Inches | | | |
| Item No. | Tricot Machine | Machine Width | Quality | 1st Front | 2nd | 3rd | 4th Back |
| 1A | 32 gauge | 184" | 8" | 78 | 51 | 73 | 34 |
| 1B | " | " | 11" | 68.5 | 67 | 72.5 | 39 |
| 1C | 28 gauge | " | 10" | 74 | 63 | 57 | 33 |
| 1D | " | " | " | 72 | 63 | 53 | 14 |
| 1E | " | " | " | 72 | 63 | 53 | 22 |
| 1F | " | " | " | 72 | 15 | 52 | 14 |
| 1G | " | " | " | 72 | 29 | 53 | 31 |
| 1H | " | " | " | 72 | 28 | 52 | 11½ |
| 1I | " | " | " | 69 | 30 | 60 | 15 |

TABLE V

| | | | Finished Fabric Properties | | | |
|---|---|---|---|---|---|---|
| Item No. | Greige Wt. oz/yd$^2$ | Wt. oz/yd$^2$ | Count WPI × CPI | Thick-ness BSI | Bulk cc/g | Hand Stretch (%) Length × Width |
| 1A | 7.9 | 13.7 | 60 × 96 | .094" | 5.14 | 150 × 77 |
| 1B | 7.6 | 15.1 | 60 × 96 | .089" | 4.42 | 145 × 85 |
| 1C | 7.6 | 13.3 | 60 × 100 | .095" | 5.35 | 120 × 100 |
| 1D | 5.6 | 7.8 | 52 × 76 | .072" | 6.87 | 92 × 65 |
| 1E | 5.1 | 8.0 | 33 × 115 | .090" | 8.46 | 130 × 18 |
| 1F | 4.9 | 6.8 | 62 × 75 | .055" | 6.10 | 88 × 105 |
| 1G | 6.4 | 11.5 | 65 × 112 | .070" | 4.55 | 90 × 105 |
| 1H | 5.4 | 7.1 | 57 × 90 | .058" | 6.09 | 102 × 88 |
| 1I | 3.3 | 6.4 | 38 × 112 | .053" | 6.22 | 120 × 28 |

I claim:

1. In a knitted fabric that includes four (4) sets of threads knitted in a stitch pattern from first, second, third and fourth guide bars of a warp knitting machine forming spaced wales of knitted loops, the improvement comprising:

(a) first guide bar threads of continuous filament yarn partially threaded in the first guide bar with at least one end in and one end out and using a knit-in stitch pattern;

(b) second guide bar threads of a yarn having a denier at least twice that of the first guide bar yarn partially threaded in said second guide bar to duplicate the threading of the first guide bar and laid-in;

(c) third guide bar threads of continuous filament yarn fully threaded in said third guide bar using a knit-in stitch pattern; and (d) fourth guide bar threads of elastomeric yarn fully threaded in said fourth guide bar using a knit-in stitch pattern.

2. The knitted fabric of claim 1, said first guide bar threads being knit with a (1-0, 0-1) stitch pattern, second guide bar threads being laid in with a (0-0, 5-5) stitch pattern, said third guide bar threads being knit with a (2-3, 1-0) stitch pattern and said fourth guide bar threads being knit with a (1-0, 1-2) stitch pattern with said partially threaded guide bars having 2 ends in and 2 ends out, the remaining guide bars being fully threaded.

3. The knitted fabric of claim 1, said first guide bar threads being knit with a (0-1, 1-2, 2-3, 2-1) stitch pattern, said second guide bar threads being knit with a (0-0, 6-6, 2-2, 6-6) stitch pattern, said third guide bar threads being knit with a (2-3, 1-0) stitch pattern, said fourth guide bar threads being knit with a (1-0, 1-2) stitch pattern with said partially threaded guide bars having 2ends in and 2ends out, the remaining guide bars being fully threaded.

4. The knitted fabric of claim 1, said second guide bar yarn being hydrophilic.

5. The knitted fabric of claim 1, the first guide bar knitted with a chain stitch, said third guide bar knitted with a float stitch and said fourth guide bar knitted with a float stitch.

6. The knitted fabric of claim 1, the first guide bar knitted with a chain stitch, the third guide bar knitted with a float stitch, and said fourth guide bar knitted with a laid in stitch.

7. In a knitted fabric that includes four (4) sets of threads knitted in a stitch pattern from first, second, third and fourth guide bars of a warp knitting machine forming spaced wales of knitted loops, the improvement comprising:

(a) first guide bar threads of continuous filament yarn partially threaded in the first guide bar with at least one end in and one end out and using a knit-in stitch pattern;

(b) second guide bar threads of a yarn having a denier at twice that of the first guide bar yarn partially threaded in said second guide bar to duplicate the threading of the first guide bar and laid-in;

(c) third guide bar threads of elastomeric yarn fully threaded in said third guide bar using a knit-in stitch pattern; and (d) fourth guide bar threads of continuous filament yarn fully threaded in said fourth guide bar using a knit-in stitch pattern.

* * * * *